US008776916B2

(12) United States Patent
Dick

(10) Patent No.: US 8,776,916 B2
(45) Date of Patent: Jul. 15, 2014

(54) DRILLING MOTORS WITH ELASTICALLY DEFORMABLE LOBES

(75) Inventor: Aaron J. Dick, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 368 days.

(21) Appl. No.: 13/175,093

(22) Filed: Jul. 1, 2011

(65) Prior Publication Data

US 2013/0000986 A1 Jan. 3, 2013

(51) Int. Cl.
*E21B 4/02* (2006.01)

(52) U.S. Cl.
USPC ..... 175/107; 175/93

(58) Field of Classification Search
USPC ..... 175/92, 93, 95, 107; 29/88.025
See application file for complete search history.

(56) References Cited

U.S. PATENT DOCUMENTS

| | | | |
|---|---|---|---|
| 4,187,061 | A | 2/1980 | Jurgens |
| 5,171,138 | A | 12/1992 | Forrest |
| 2006/0131079 | A1 | 6/2006 | Bottos |
| 2006/0216178 | A1 | 9/2006 | Sindt et al. |
| 2007/0140883 | A1 | 6/2007 | Lievestro et al. |
| 2009/0016893 | A1 | 1/2009 | Lee et al. |
| 2010/0038142 | A1 | 2/2010 | Snyder et al. |

OTHER PUBLICATIONS

International Search Report and Written Opinion dated Jan. 14, 2013 for International Application No. PCT/US2012/044975.

*Primary Examiner* — Cathleen Hutchins
(74) *Attorney, Agent, or Firm* — Cantor Colburn LLP

(57) ABSTRACT

In an aspect, a drilling motor is provided that in one embodiment includes a stator and a rotor configured to be disposed in the stator, wherein the rotor includes a lobe member having an elastically deformable surface configured to provide an interference seal between the stator and the rotor.

21 Claims, 4 Drawing Sheets

DRILLING MOTORS WITH ELASTICALLY DEFORMABLE LOBES

BACKGROUND INFORMATION

1. Field of the Disclosure

This disclosure relates generally to drilling motors for use in drilling of wellbores.

2. Brief Description of the Related Art

To obtain hydrocarbons, such as oil and gas, boreholes or wellbores are drilled by rotating a drill bit attached to a drill string end. A substantial proportion of the current drilling activity involves drilling deviated and horizontal boreholes to increase the hydrocarbon production and/or to withdraw additional hydrocarbons from the earth's formations. Directional drilling systems generally employ a drill string having a drill bit at the bottom that is rotated by a positive displacement motor (commonly referred to as a "mud motor" or a "drilling motor"). A typical mud motor includes a power section that contains a stator and a rotor disposed in the stator. The stator typically includes a metal housing lined inside with a helically contoured (lobed) elastomeric material. The rotor is typically made from a suitable metal, such as steel, and includes lobes on its outside surface. Some mud motors include a metallic stator and a metallic rotor. Pressurized fluid (commonly known as the "mud" or "drilling fluid") is pumped into a progressive cavities formed between the rotor and stator lobes. The force of the pressurized fluid pumped into the cavities causes the rotor to turn in a planetary-type motion. In the metal-metal stator and rotor mud motor, a clearance is designed between the rotor and stator to allow assembly of the mud motor. Such a construction loses efficiency as the drilling fluid flows across the clearance between the cavities. The efficiency of such metal-metal mud motors is typically lower than a rubber stator and metal rotor mud motor due to the lack of sealing between the rotor and stator.

The disclosure herein provides metal-metal mud motors with an interference seal between the rotor and the stator.

SUMMARY

In one aspect, a drilling motor is provided that in one embodiment includes a metallic stator and a metallic rotor configured to be disposed in the stator, wherein the rotor includes a lobe member that provides an interference seal between the stator and the rotor.

In another aspect, a method of making a drilling motor is provided that in one embodiment includes providing a metallic stator; proving a metallic rotor that includes a lobe member that is configured to provide an interference seal between the rotor lobe and the stator; placing the rotor in the stator to form the drilling motor.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE EMBODIMENTS

Figure 1:
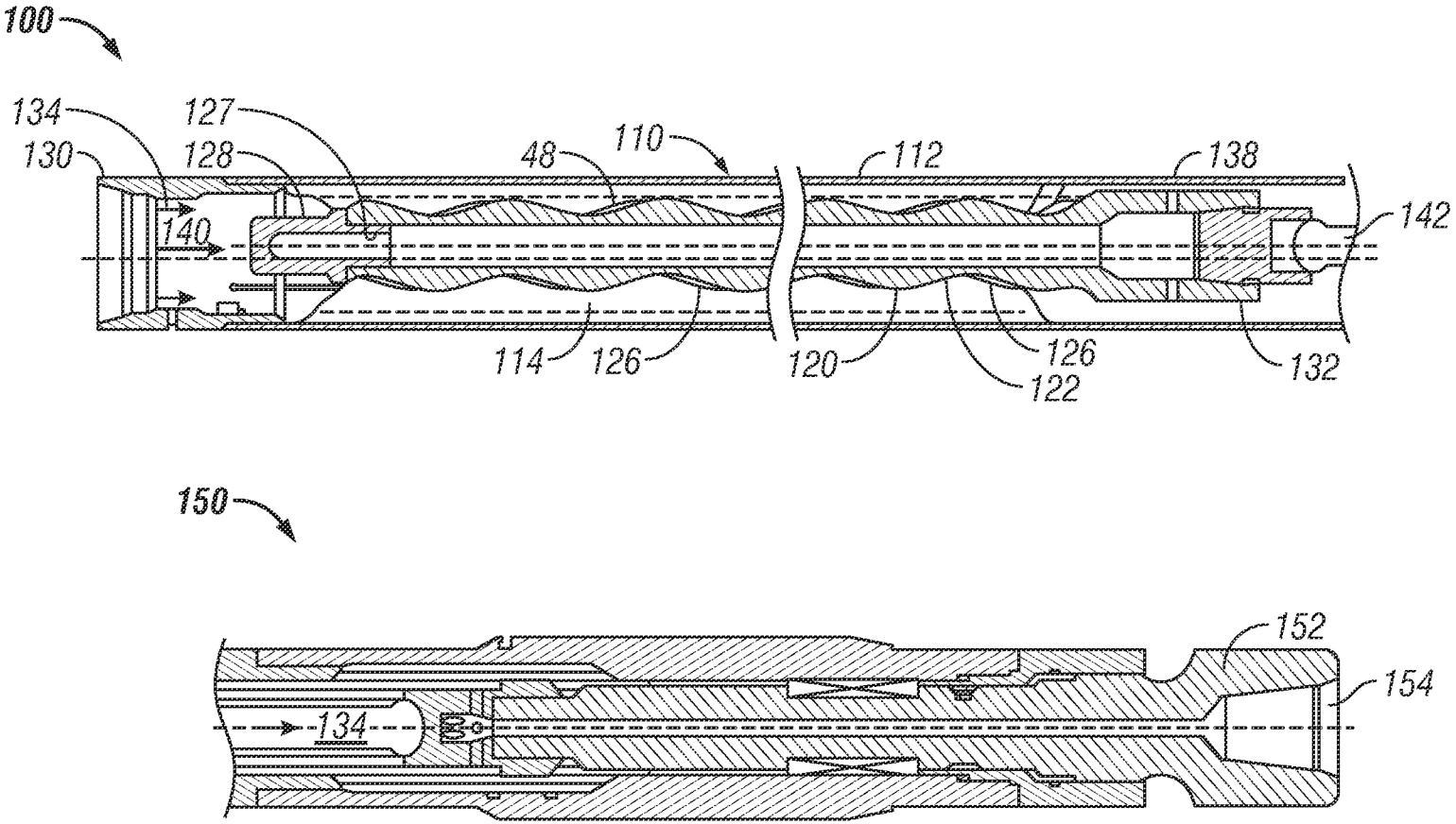
FIG. 1 shows an exemplary drilling system that includes a drilling assembly that contains a drilling motor made according to an embodiment of the disclosure.

FIG. 1 shows a cross-section of an exemplary drilling motor 100 that includes a rotor made according to an embodiment of the disclosure. The drilling motor 100 includes a power section 110 and a bearing assembly 150. The power section 110 contains an elongated metal housing 112 having therein a stator 114 that includes lobes 118. The stator lobes may be made of metallic, non-elastomeric or another stiff material. The stator 114 is secured inside the housing 112 or formed integral with the housing 112. A rotor 120 made of a suitable metal or an alloy includes lobes 122. The rotor 120 is rotatably disposed inside the stator 114. The stator 114 includes one lobe more than the number of rotor lobes. In aspects, the rotor 120 may have a bore 124 that terminates at a location 127 below the upper end 128 of the rotor 120 as shown in FIG. 1. The bore 124 remains in fluid communication with the drilling mud 140 below the rotor 120 via a port 138. The rotor lobes 122 and the stator lobes 118 and their helical angles are such that the rotor 120 and the stator 114 seal (seals are typically leaky in metal-metal mud motors), at discrete intervals, resulting in the creation of axial fluid chambers or cavities 126 which are filled by the pressurized drilling fluid or mud 140 when such fluid is supplied to the motor 100 from the surface during drilling of a wellbore. The pressurized drilling fluid 140 flowing from the top 130 of the motor 100 to the bottom 152 of the power section 150, as shown by arrow 134, causes the rotor 120 to rotate within the stator 114. The design and number of the lobes 118 and 122 define the output characteristics of the motor 100. In one configuration, the rotor 120 is coupled to a flexible shaft 142 that connects to a rotatable drive shaft 152 in the bearing assembly 150 that carries a drill bit (not shown) in a suitable bit box 154. During a drilling operation, the pressurized fluid 140 rotates the rotor 120 that in turn rotates the flexible shaft 142. The flexible shaft 142 rotates the drill shaft 152, which in turn rotates the bit box 154 and thus the drill bit. In aspects, the rotor lobes 122 are elastically deformable that provide interference seals between the rotor and stator lobes. Various exemplary configurations of such deformable lobes are described below in reference to FIGS. 2-6.

Figure 2:
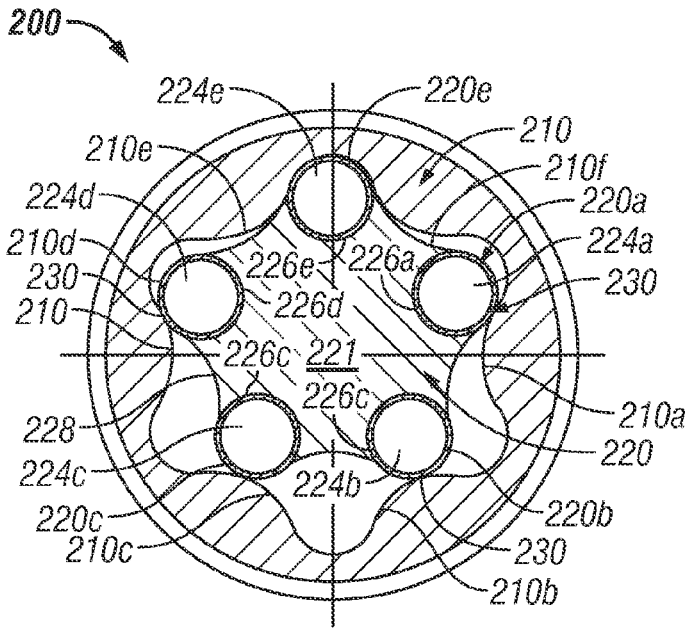
FIG. 2 shows a cross-section of a mud motor that includes compliant metal tubular lobes attached to the rotor body.

FIG. 2 shows a cross-sectional view of a mud motor 200 that includes a stator 210 and a rotor 220 disposed in the stator 210. The particular configuration of the mud motor 200 shown in FIG. 2 includes stator lobes 210*a*-210*f* and rotor lobes 220*a*-220*e*. The rotor 220 includes a rotor body 221 that has the lobes 220*a*-220*e* attached thereto. The rotor lobes 220*a*-220*e* may be formed using tubular members or tubes 224*a*-224*e* formed from a metallic or another suitable elastically deformable material. In one aspect, the tubes 224*a*-224*e* may be pre-formed and subsequently attached to their corresponding compliant cavities 226*a*-226*e* formed on the outer surface 228 of the rotor body 221. The tubes 224*a*-224*e* may be attached to the rotor body 221 by any suitable mechanism, including, but not limited to, soldering, brazing, welding and mechanical attachments. The rotor lobes 220*a*-220*e* are compliant with the stator lobes 210*a*-210*f*, in that when the rotor rotates in the stator, the tubes 220*a*-220*e* elastically deform creating interference seals 230 between the stator lobes 210*a*-210*f* and rotor lobes 220*a*-220*e*. In one aspect, the outer dimension of each tube 224*a*-224*e* is slightly greater than the inner dimension of each of the stator lobe 210*a*-210*f*. When the rotor 220 is inserted in the stator 210, the tubes 224*a*-224*e* rotate and press against the metallic stator lobes 210*a*-210*f* and elastically deform, thereby providing interference seals 230 between the stator and rotor lobes.

Figure 3:
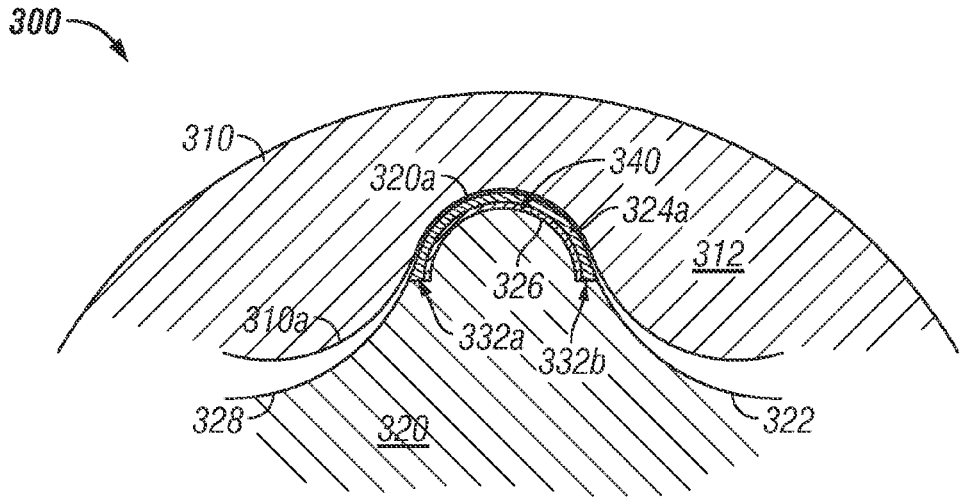
FIG. 3 shows a cross-section of a mud motor that includes lobes made of half-tubes attached to the rotor body, with a gap between the half tubes and the rotor body.

FIG. 3 shows a partial cross-section of an embodiment of a mud motor 300 that includes a stator 310 and a rotor 320 disposed in the stator 310. The stator 310 includes a stator body 312 and a lobe 310*a*. The rotor 320 includes a rotor body 322 and a lobe 320*a* on the rotor body 322. The lobe 320*a* is a half tube 324*a* and may be formed of a suitable metallic or another elastically deformable material. In one aspect, the half tube 324*a* may be pre-formed and then attached in a compliant reduced diameter outer surface 326 formed on the outer surface 328 of the rotor body 322. In one configuration the half tube 324*a* may be affixed at ends 332*a* and 332*b* in the outer surface 328 of the rotor 320. In one configuration, a void 340 may be provided between the half tube 324*a* and the convex surface 326. The void 340 between the half tube 324*a* and surface 326 allows the compliant half tube 324*a* to deflect by a controlled amount. Such controlled deflection provides an interference seal between the half tube 324*a* and the stator lobe 310*a* and also prevents a large strain and plastic deformation of the half tube 324*a*. The half tube 324*a* may be attached to the rotor body 322 by any suitable mechanism, including, but not limited to, soldering, brazing, welding and mechanical attachments. The half tube 324*a* is compliant with the stator lobes 310, in that when the rotor 320 rotates in the stator 310, the half-tube 324*a* elastically deforms, creating an interference seal between the stator lobe 310*a* and rotor lobes 320*a*. Although the mud motor 300 shown in FIG. 3 shows a half-tube as the rotor lobe forming member, any other suitable shape for such a member may be utilized.

Figure 4:
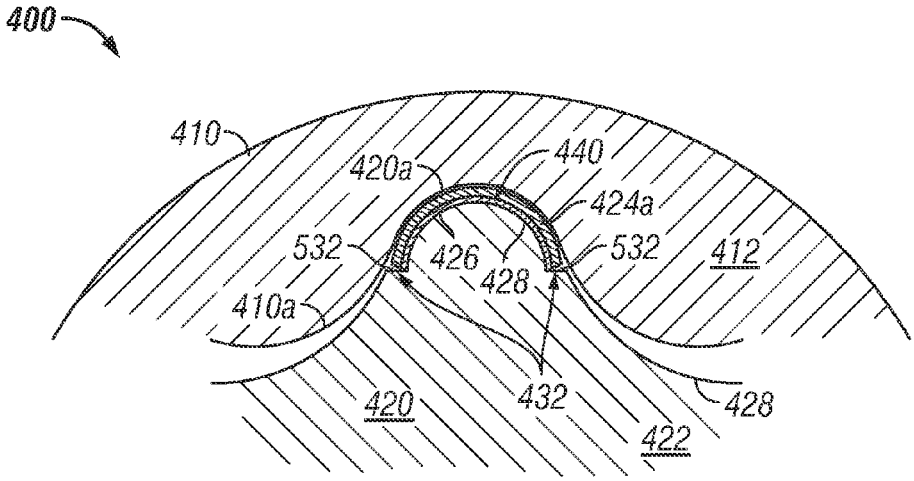
FIG. 4 shows a cross-section of a mud motor that includes lobes made of half-tubes attached to the rotor body, with a compliant material between the rotor body and the half tubes.

FIG. 4 shows a partial cross-section of an embodiment of a mud motor 400 that includes a stator 410 and a rotor 420 disposed in the stator 410. The stator 410 includes a stator body 412 and a lobe 410*a*. The rotor 420 includes a rotor body 422 and a lobe 420*a* on the rotor body 422. The lobe 420*a* is a half tube 424*a* and may be formed of a suitable metallic or other elastically deformable material. In one aspect, the half tube 424*a* may be pre-formed and then attached in a compliant reduced diameter outer surface 426 formed on the outer surface 428 of the rotor body 422. In one configuration the half-tube 424*a* may be placed at free ends 432 in the outer surface 428 of the rotor 420 over a compliant member 440. The compliant member 440 may be a spring or another suitable low modulus material or member. In one configuration, the half-tube 424*a* is composed of a rigid wear resistance material and is bonded or attached to the compliant member 440. The compliant member 440 between the half-tube 424*a* and surface 426 allows the half-tube 424*a* to deflect by a controlled amount to provide an interference seal between the half-tube 424*a* and the stator lobe 410*a* and also prevents a large strain and plastic deformation of the half-tube 424*a*. The half-tube 424*a* may be bonded or attached to the rotor body 422 by any suitable mechanism, including, but not limited to, soldering, welding and mechanical attachments. The half tube 424*a* is compliant with the stator lobe 410*a* in that when the rotor 420 rotates in the stator 410, the half-tube 424*a* elastically deforms creating an interference seal between the stator lobe 410*a* and rotor lobe 420*a*. Although the mud motor 400 shown in FIG. 4 shows a half-tube as the rotor lobe forming member, any other suitable shape for such a member may be utilized.

Figure 5:
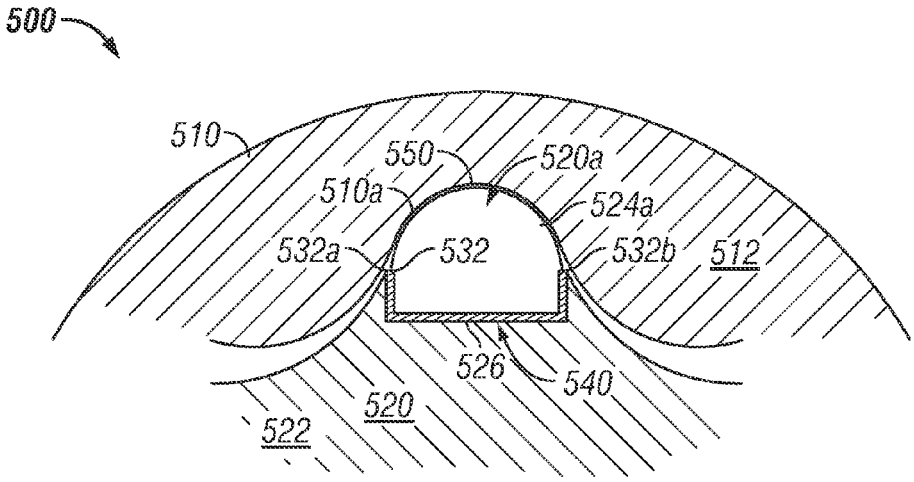
FIG. 5 shows a cross-section of a mud motor that includes compliant lobes made of stiff or solid half-tubes bonded to flexible members.

FIG. 5 shows a partial cross-section of an embodiment of a mud motor 500 according to yet another embodiment of the disclosure. The mud motor 500 includes a stator 510 and a rotor 520 disposed in the stator 510. The stator 510 includes a stator body 512 and a lobe 510*a*. The rotor 520 includes a rotor body 522 and a lobe 520*a* on the rotor body 522. The lobe 520*a* is made of a half-tube 524*a* that may be a stiff tube or a solid metallic member. In one aspect, the half-tube 524*a* may be pre-formed and securely placed on a compliant material or member 540 in a compliant cavity 526 formed in the rotor body 522. The compliant member 540 may be a spring or another suitable low modulus material or member. In aspects, the compliant member 540 between the half-tube 524*a* and cavity 526 allows the half-tube 524*a* to deflect by a controlled amount to provide an interference seal 550 between the half-tube 524*a* and the stator lobe 510*a*. The half-tube 524*a* may be bonded or attached to the rotor body 522 at ends 532*a* and 532*b* of the cavity 526 by any suitable mechanism, including, but not limited to, soldering, welding and mechanical attachments. The half-tube 524*a* is compliant with the stator lobe 510*a* in that when the rotor 520 rotates in the stator 510, the half-tube 524*a* deflects by a selected amount, creating an interference seal between the stator lobe 510*a* and rotor lobe 520*a*. Although the mud motor 500 shown in FIG. 5 shows a half-tube as the rotor lobe member, any other suitable shape for such a member may be utilized.

In each of the mud motor embodiments shown in FIGS. 2-5, the lobes may be attached to the rotor body by any suitable mechanism, including, but not limited to, bonding the lobe to the rotor by welding, brazing and soldering. The lobes may be machined and finished before or after attaching the lobes to the rotor body.

Figure 6:
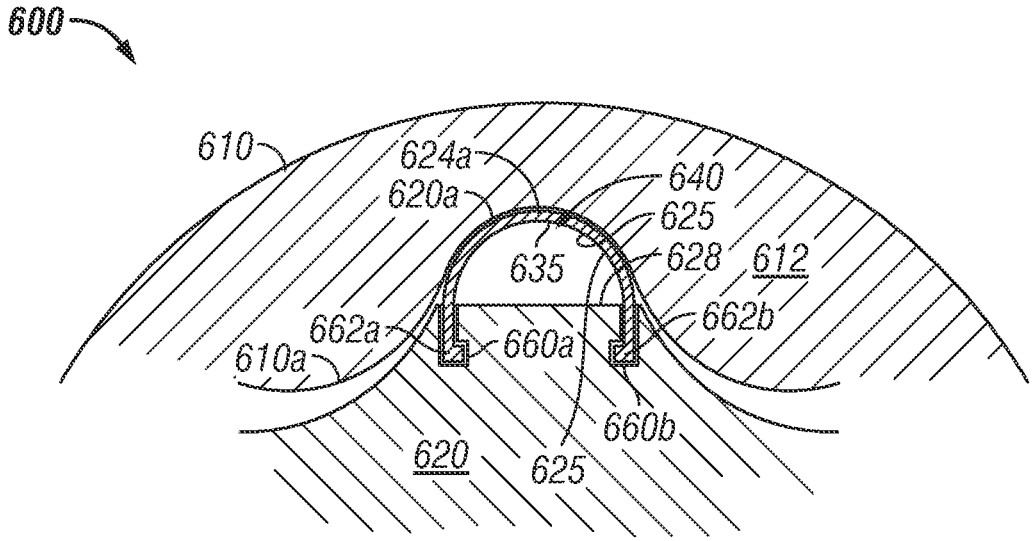
FIG. 6 shows a cross-section of a mud motor that includes compliant lobes made of half-tubes configured to mechanically lock to the rotor body.

FIG. 6 shows a partial cross-section of a mud motor 600 according to yet another embodiment of the disclosure. The mud motor 600 includes a stator 610 and a rotor 620 disposed in the stator 610. The stator 610 includes a stator body 612 and a lobe 610*a*. The rotor body 622 includes locking keyways 660*a* and 660*b* along the rotor body. The lobe 620*a* is formed by a half-tube 624*a* that includes locking keys 662*a* and 662*b* along its length of the rotor 620 configured to mechanically lock in the keyways 660*a* and 660*b* respectively. The number and dimensions of the keys and the keyways are selected based on the design criteria. In one aspect, the half-tube 624*a* shown is a hollow member that provides a void 635 between the inner side 625 of the half-tube 624*a* and a surface 628 of the rotor body 622. The half-tube 624*a* provides an interference seal between the stator lobe 610*a* and the rotor lobe 620*a*.

In aspects, the mud motors made according to an embodiment of the disclosure eliminate the use of rubber in the stator, thus permitting the mud motor to operate at higher downhole temperatures compared to the mud motors that utilize rubber or elastomeric stators. In another aspect, the metal-metal interference seal between stator and rotor overcomes the lower flow efficiency of conventional metal-metal mud motors. In aspects, the compliant lobes may be made from any suitable erosion-resistant and wear-resistant material. Such materials include, but are not limited to: heat-treated steel; surface treated steel; low galling metal alloys, such as copper, tin, nickel alloys and beryllium copper alloys and spinodally hardened versions thereof. The compliant members may be coated with suitable materials to improve wear resistance. The shape of the compliant members may include other suitable shapes. In addition, a low modulus material may be substituted for the hollow members to allow elastic deformation and sealing contact with the stator. The hollow members may have ports to equalize the internal and external hydrostatic fluid pressure.

Materials suitable for the rotor deformable lobes that have high wear resistance to drilling fluids containing abrasive particles include, but are not limited to, metals containing carbides harder than quartz, such as chromium, tungsten and or vanadium or coatings thereof. The deformable lobes may include but are not limited to hard material wear surfaces such as hard ceramics or cermets, such as alumina, zirconium, boron carbide, silicon carbide, silicon nitride and titanium carbide. Additionally, the rotor and/or stator may be coated with a material having high hardness but low friction, such as DLC or WC/C or with a material that is non-galling when rotor rotates in the stator, which material may include, but is not limited to, silver, copper, bronze. The deformable lobe material or coating applied to the rotor may be dissimilar from the material or coating applied to the stator.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. A drilling motor comprising:

a stator having a lobe; and a rotor configured to be disposed in the stator, wherein the rotor includes a rotor body having a plurality of rotor lobes, wherein a selected rotor lobe includes a lobe member attached to the rotor lobe, the lobe member being configured to elastically deform to provide an interference seal between the lobe of the stator and the selected rotor lobe when the rotor rotates in the stator.

2. The drilling motor of claim 1, wherein the lobe member is selected from a group consisting of: (i) a hollow member; (ii) a member made from a material having Young's modulus lower than that of the stator.

3. The drilling motor of claim 1, wherein the lobe member is selected from a group consisting of: (i) a tube member; and (ii) a half tube member.

4. The drilling motor of claim 1 further comprising a gap between the lobe member and the rotor body.

5. The drilling motor of claim 1 further comprising a support member configured to provide a spring action to the lobe member.

6. The drilling motor of claim 4, wherein the lobe member includes a stiff member and a compliant member or a spring member coupled to the rotor body.

7. The drilling motor of claim 1 further comprising a compliant member between the lobe member and the rotor body.

8. The drilling motor of claim 1, wherein the lobe member is attached to the rotor body by at least one of: (i) soldering; (ii) welding; and (iii) brazing.

9. The drilling motor of claim 1, wherein the lobe member includes locking members configured to engage with key members in the rotor to cause the lobe member to be attached to the rotor.

10. A drilling apparatus, comprising:

a bottomhole assembly including a drilling motor configured to rotate a drill bit, wherein the drilling motor comprises:

a stator having a lobe; and a rotor configured to be disposed in the stator, wherein the rotor includes a rotor body having a plurality of rotor lobes, wherein a selected rotor lobe includes a lobe member attached to the rotor lobe, the lobe member being configured to elastically deform to provide an interference seal between the lobe of the stator and the selected rotor lobe when the rotor rotates in the stator.

11. A method of making a drilling motor, comprising:

providing a stator having a lobe;

providing a rotor that includes a rotor body having a plurality of rotor lobes, wherein a selected rotor lobe includes a lobe member attached to the rotor lobe, the lobe member being configured to elastically deform when the rotor is rotated inside the stator to provide an interference seal between the lobe of the stator and the selected rotor lobe; and placing the rotor in the stator to form the drilling motor.

12. The method of claim 11, wherein the lobe member is selected from a group consisting of: (i) a hollow member; (ii) a member made from a material having Young's modulus lower than that of the stator.

13. The method of claim 11, wherein the lobe member is selected from a group consisting of: (i) a tube member; and (ii) a half tube member.

14. The method of claim 11 further comprising providing a gap between the lobe member and the rotor body.

15. The method of claim 11 further comprising providing a support member between the lobe member and the rotor body to provide a spring action to the lobe member.

16. The method of claim 11, wherein the lobe member includes a stiff member and a compliant member or a spring member coupled to the rotor body.

17. The method of claim 11 further comprising providing a compliant member between the lobe member and the rotor body.

18. The method of claim 11, wherein the stator includes an inner metallic surface and the lobe member includes an outer metallic surface.

19. The method of claim 11 further comprising attaching the lobe member to the rotor body a body by at least one of: (i) soldering; (ii) welding; and (iii) brazing.

20. The method of claim 11, wherein the lobe member includes a locking member configured to engage with a key member in the rotor to cause the lobe member to attach to the rotor.

21. The drilling motor of claim 1, wherein a location of the selected lobe on the rotor body further comprises a cavity or reduced diameter region formed in the rotor body and the lobe member is attached to the cavity or reduced diameter region.

* * * * *